US009108081B2

(12) United States Patent
Giannelli et al.

(10) Patent No.: US 9,108,081 B2
(45) Date of Patent: Aug. 18, 2015

(54) EXERCISE APPARATUS

(75) Inventors: Raymond Giannelli, Franklin, MA (US); Scott Lee, Pomfret, CT (US)

(73) Assignee: Cybex International, Inc., Medway, MA (US)

( * ) Notice: Subject to any disclaimer, the term of this patent is extended or adjusted under 35 U.S.C. 154(b) by 536 days.

(21) Appl. No.: 12/349,593

(22) Filed: Jan. 7, 2009

(65) Prior Publication Data

US 2009/0176625 A1 Jul. 9, 2009

Related U.S. Application Data

(63) Continuation-in-part of application No. 10/294,017, filed on Nov. 13, 2002, now abandoned, and a continuation-in-part of application No. 10/806,833, filed on Mar. 22, 2004, now Pat. No. 8,025,609, and a (Continued)

(51) Int. Cl.

| | |
|---|---|
| ***A63B 22/00*** | (2006.01) |
| ***A63B 71/00*** | (2006.01) |
| ***A63B 22/20*** | (2006.01) |

(Continued)

(52) U.S. Cl.

CPC ..... *A63B 22/201* (2013.01); *A63B 22/001* (2013.01); *A63B 21/005* (2013.01); *A63B 21/008* (2013.01); *A63B 21/012* (2013.01); *A63B 21/225* (2013.01); *A63B 2022/0038* (2013.01); *A63B 2022/0041* (2013.01); *A63B 2022/0043* (2013.01); *A63B 2022/206* (2013.01); *A63B 2071/025* (2013.01)

(58) Field of Classification Search

USPC ..... 482/51, 52, 53, 57, 79, 80; D21/688

See application file for complete search history.

(56) References Cited

U.S. PATENT DOCUMENTS

| | | | |
|---|---|---|---|
| 219,439 | A | 9/1879 | Miller |
| 2,969,060 | A | 7/1959 | Swanda et al. |

(Continued)

FOREIGN PATENT DOCUMENTS

| | | | |
|---|---|---|---|
| CA | 2407758 | A1 | 11/2004 |
| GB | 2369586 | A | 6/2002 |

(Continued)

OTHER PUBLICATIONS

Standing Ellipticals (Q47, Q37, and Q35 Series), Octane Fitness, http://home.octanefitness.com/products/series_detail.cfm?ITEM_ID=6&ITEM_TYPE=S.

(Continued)

*Primary Examiner* — Loan H Thanh
*Assistant Examiner* — Sundhara Ganesan
(74) *Attorney, Agent, or Firm* — Novak Druce Connolly Bove + Quigg LLP

(57) ABSTRACT

An exercise apparatus that has:

a frame;

a curved ramp comprised of a non-articulating, non-pivoting curved member that defines a unitary curved path of travel between a selected forward and selected rearward position;

a foot support adapted to travel along the unitary curved path from the selected forward position to the selected rearward position and to travel along the same unitary curved path from the selected rearward position to the selected forward position; and a handle interconnected to the foot support and adapted to move in the same direction, forward or rearward, as the foot support via the interconnection to the foot support.

18 Claims, 13 Drawing Sheets

Related U.S. Application Data continuation-in-part of application No. 12/053,254, filed on Mar. 21, 2008, now Pat. No. 8,057,363, and a continuation-in-part of application No. 12/053,234, filed on Mar. 21, 2008, now Pat. No. 8,454,478.

(60) Provisional application No. 61/019,691, filed on Jan. 8, 2008, provisional application No. 60/337,498, filed on Nov. 13, 2001, provisional application No. 60/534,904, filed on Jan. 8, 2004.

(51) Int. Cl.

| | |
|---|---|
| *A63B 21/005* | (2006.01) |
| *A63B 21/008* | (2006.01) |
| *A63B 21/012* | (2006.01) |
| *A63B 21/22* | (2006.01) |
| *A63B 71/02* | (2006.01) |

(56) References Cited

U.S. PATENT DOCUMENTS

| | | | | |
|---|---|---|---|---|
| 5,039,088 | A * | 8/1991 | Shifferaw | 482/51 |
| 5,147,257 | A * | 9/1992 | Loane | 482/71 |
| 5,232,423 | A * | 8/1993 | Hajduczek | 482/68 |
| 5,772,558 | A * | 6/1998 | Rodgers, Jr. | 482/51 |
| 5,833,584 | A * | 11/1998 | Piaget et al. | 482/70 |
| 5,921,894 | A | 7/1999 | Eschenbach | |
| 5,957,814 | A | 9/1999 | Eschenbach | |
| 6,004,244 | A | 12/1999 | Simonson | |
| 6,019,709 | A * | 2/2000 | Piaget | 482/70 |
| 6,142,915 | A | 11/2000 | Eschenbach | |
| 6,210,305 | B1 * | 4/2001 | Eschenbach | 482/52 |
| 6,422,977 | B1 | 7/2002 | Eschenbach | |
| 6,440,042 | B2 * | 8/2002 | Eschenbach | 482/52 |
| 6,689,019 | B2 | 2/2004 | Ohrt et al. | |
| 6,726,600 | B2 | 4/2004 | Miller | |
| 6,752,744 | B2 | 6/2004 | Arnold et al. | |
| 6,875,160 | B2 | 4/2005 | Watterson et al. | |
| 6,949,053 | B1 | 9/2005 | Stearns et al. | |
| 6,994,657 | B1 * | 2/2006 | Eschenbach | 482/52 |
| 7,060,004 | B2 | 6/2006 | Kuo | |
| 7,238,146 | B1 * | 7/2007 | Chen | 482/52 |
| 7,364,532 | B2 | 4/2008 | Maresh | |
| 7,666,122 | B2 * | 2/2010 | Chiles et al. | 482/52 |
| 7,717,828 | B2 * | 5/2010 | Simonson et al. | 482/52 |
| 2001/0012811 | A1 * | 8/2001 | Gordon | 482/70 |
| 2002/0019298 | A1 | 2/2002 | Eschenbach | |
| 2002/0042329 | A1 * | 4/2002 | Nizamuddin | 482/51 |
| 2003/0092532 | A1 | 5/2003 | Giannelli et al. | |
| 2006/0009330 | A1 | 1/2006 | Lo | |
| 2006/0116247 | A1 | 6/2006 | Dyer et al. | |
| 2006/0189447 | A1 | 8/2006 | Dyer et al. | |
| 2007/0161464 | A1 | 7/2007 | Chiles et al. | |
| 2007/0238583 | A1 | 10/2007 | Cunningham | |
| 2007/0254778 | A1 | 11/2007 | Ashby | |
| 2008/0032869 | A1 * | 2/2008 | Pacheco et al. | 482/52 |
| 2008/0051260 | A1 | 2/2008 | Simonson et al. | |

FOREIGN PATENT DOCUMENTS

| | | | |
|---|---|---|---|
| GB | 2429932 | B | 8/2007 |
| GB | 2447607 | A | 9/2008 |
| WO | 88/10136 | | 12/1988 |
| WO | 00/25694 | | 5/2000 |
| WO | 00/62865 | | 10/2000 |
| WO | 2007/035477 | A1 | 3/2007 |
| WO | 2008/017049 | A3 | 2/2008 |

OTHER PUBLICATIONS

NordicTrack ASR 1000 Elliptical, NordicTrack, http://www.nordictrack.com/webapp/wcs/stores/servlet/product2__12401__10301__48701__1__19053.

Summit Trainers, Life Fitness, http://us.commerical.lifefitness.com/content.dfm/summittrainers.

Cateye EC 6000 Elliptical Trainer, Cateye Fitness, http://www.treadmillscentral.com/cateye__fitness__ec__6000.html.

EPIC 950 E Elliptical Trainer, EPIC, http://www.treadmill-world.com/epic-950-elliptical.html.

ESX Touch Screen Elliptical, True Fitness, http://www.truefitness.com/products/residential/product.aspx? seriesID=52 &productID=86&show=1.

NordicTrack A.C.T. Elliptical, NordicTrack, http://www.nordictrack.com/webapp/wcs/stores/servlet/product2__12401__10301__65101__1__19053.

Ellipticals, Diamondback Fitness, http://www.diamondbackfitness.com/.

Cybex Excursion Exercise Apparatus.

* cited by examiner

EXERCISE APPARATUS

RELATED APPLICATIONS

This application claims the benefit of priority to U.S. Provisional Application No. 61/019,691 filed Jan. 8, 2008. This application is also a continuation-in-part of and claims the benefit of priority under 35 U.S.C. Sections 119 and 120 to U.S. patent application Ser. No. 10/294,017 filed Nov. 13, 2002 which claims priority to Provisional Application No. 60/337,498 filed Nov. 13, 2001. This application is also a continuation-in-part of and claims the benefit of priority under 35 U.S.C. Sections 119 and 120 to U.S. patent application Ser. No. 10/806,833 filed Mar. 22, 2004 which claims priority to Provisional Application No. 60/534,904 filed Jan. 8, 2004. This application is also a continuation-in-part of and claims the benefit of priority under 35 U.S.C. Sections 119 and 120 to U.S. patent application Ser. No. 12/053,254 filed Mar. 21, 2008. This application is also a continuation-in-part of and claims the benefit of priority under 35 U.S.C. Sections 119 and 120 to U.S. patent application Ser. No. 12/053,234 filed Mar. 21, 2008. The disclosures of all of the foregoing applications are incorporated by reference herein in their entirety as if fully set forth herein.

FIELD OF THE INVENTION

The present invention relates to physical exercise machines and more particularly to an exercise apparatus that enables users to perform a simulated walking, running or other back and forth leg movement exercise.

BACKGROUND OF THE INVENTION

Exercise machines for simulating walking or running are known and used for directing the movement of a user's legs and feet in a variety of repetitive paths of travel. Machines commonly referred to as elliptical path machines have been designed to pivot the foot pedals on which the user's feet reside causing the pedals and the user's feet to travel in an elliptical path. The path of travel of the foot pedals in such prior machines is different from front to back and the angular degree of pivoting of the foot pedals changes as the foot pedal travels from back to front and front to back by typically more than about 3 degrees and more typically more than 10-30 degrees.

SUMMARY OF THE INVENTION

In accordance with one embodiment of the invention, there is provided an exercise device comprising:

- a foot support arranged on a frame for supporting a user standing upright on the foot support, the foot support being movable back and forth between a rearward position and a forward position along a curved path on a ramp mounted to the frame;
- the foot support being supported on a rear linkage that is pivotally interconnected to a manually graspable arm that is pivotably mounted to the frame at a select pivot point;
- the arm being pivotable forwardly and backwardly in the same direction respectively with forward and backward movement of the foot support through the interconnection of the rear linkage to the arm.

The ramp preferably comprises a non-articulating, non-pivoting curved member that defines a unitary curved path of travel between a selected forward and a selected rearward position; and, the foot support is adapted to travel along the unitary curved path from the selected forward position to the selected rearward position and to travel along the same unitary curved path from the selected rearward position to the selected forward position.

The rear linkage is typically pivotally interconnected to a link that is directly pivotally connected to the arm. The foot support is mounted for movement back and forth between a rearward down position and a forward up position. The rear linkage can be selectively adjustable to limit the back and forth travel of the frame linkage to any one of a plurality of separate reproducible segments of the overall arcuate path. The arm has a handle disposed on one side of the select pivot point for manual pivoting of the arm around the select pivot point by the user grasping and exerting forward or backward force on the handle; and, the arm is linked to the rear linkage through an arm linkage pivotably connected to the arm on the one side of the select pivot point.

The arm is typically linked to a resistance mechanism through a first crank, the first crank being pivotably interconnected to the resistance mechanism through a second crank. The rear linkage is linked to a resistance mechanism through a first crank, the first crank being pivotably interconnected to the resistance mechanism through a second crank. The rear linkage is interconnected to a forward linkage, the forward linkage is interconnected to a resistance mechanism through a crank. The rear linkage is interconnected to a forward linkage and the forward linkage is interconnected to a resistance mechanism through a crank. The rear linkage is interconnected to a forward linkage and the forward linkage is connected to the arm linkage and a crank. The crank is interconnected to a second crank.

Further in accordance with another embodiment of the invention there is provided, an exercise device comprising:

- a foot support arranged on a frame for supporting a user standing upright on the foot support, the foot support being movable back and forth between a rearward position and a forward position along an arcuate path on a ramp mounted to the frame;
- the foot support being supported on a rear linkage that is pivotally interconnected to a manually graspable arm that is pivotably mounted to the frame at a select pivot point;
- the arm having a handle disposed on one side of the select pivot point for manual pivoting of the arm around the select pivot point by the user grasping and exerting forward or backward force on the handle;
- the arm being linked to the rear linkage through an arm linkage pivotably connected to the arm on the one side of the select pivot point.

Preferably, the arm is pivotable forwardly and backwardly in the same direction respectively with forward and backward movement of the foot support through the interconnection of the rear linkage to the arm. The arm is typically interconnected to a resistance mechanism through a crank. The foot support is preferably mounted for movement back and forth between a rearward down position and a forward up position. Typically, the rear linkage is selectively adjustable to limit the back and forth travel of the frame linkage to any one of a plurality of separate reproducible segments of the overall arcuate path. Preferably, the arm is linked to a resistance mechanism through a first crank, the first crank being pivotably interconnected to the resistance mechanism through a second crank. Typically, the rear linkage is linked to a resistance mechanism through a first crank, the first crank being pivotably interconnected to the resistance mechanism through a second crank. Preferably, the rear linkage is interconnected to a forward linkage, the forward linkage being interconnected to a resistance mechanism through a crank.

Typically, the arm linkage is connected to a forward linkage that is connected to the rear linkage. The rear linkage is typically connected to the forward linkage, the forward linkage being connected to the arm linkage and a crank. The crank is preferably interconnected to a second crank. The rear linkage can be adapted to be selectively adjustable to limit the back and forth travel of the frame linkage to any one of a plurality of separate reproducible segments of the overall arcuate path.

In another embodiment of the invention there is provided, an exercise device comprising:

a foot support arranged on a frame for supporting a user standing upright on the foot support, the foot support being movable back and forth between a rearward position and a forward position along an arcuate path on a ramp mounted to the frame;

the foot support being supported on a rear linkage that is pivotally interconnected to a manually graspable arm that is pivotably mounted to the frame at a select pivot point;

the arm being interconnected to a resistance mechanism through a crank.

Further in accordance with the invention there is provided, a method of performing an exercise comprising placing an exerciser's two feet on an exercise machine having a foot support suspended on a frame for back and forth movement, the method comprising:

supporting the foot support on curved ramp;

adapting the ramp to comprise a non-articulating, non-pivotable member that defines a unitary curved path of travel;

interconnecting the foot support to a manually graspable arm that mounted to the frame at a select pivot point for forward and backward movement around the pivot point;

adapting the interconnection of the arm and the foot support such that the foot support and the arm move forwardly and backwardly in the same direction when either is moved forwardly or backwardly;

driving one or the other or both of the foot support and the arm forwardly or backwardly with one or the other or both of a foot and a hand respectively of the user.

Preferably the method includes interconnecting the arm and the foot support to a resistance mechanism.

Further in accordance with the invention there is provided, a method of performing an exercise comprising placing an exerciser's two feet on an exercise machine having a foot support suspended on a frame for back and forth movement, the method comprising:

supporting the foot support on an arcuate ramp;

interconnecting the foot support to a manually graspable arm that is mounted to the frame at a select pivot point for forward and backward movement around the pivot point, the arm having a handle mounted on one side of the select pivot point;

connecting a link to a link pivot located on the arm in a position that is on the one side of the select pivot;

interconnecting the link to the foot support;

driving one or the other or both of the foot support and the arm forwardly or backwardly with one or the other or both of a foot and a hand respectively of the user.

In another embodiment of the invention there is provided, an exercise device comprising:

a foot support arranged on a frame for supporting a user standing upright on the foot support, the foot support being movable back and forth between a rearward position and a forward position along an arcuate path on a ramp mounted to the frame;

the foot support being supported on a rear linkage that is pivotally interconnected to a manually graspable arm that is pivotably mounted to the frame at a select pivot point for pivoting back and forth through a selectable angle, the arm and the foot support being interconnected such that driven movement of one of the arm or the foot support causes driven movement of the other;

an arm lever or crank rigidly connected or interconnected to the arm in an arrangement such that movement of the arm back or forth through the selectable angle causes simultaneous movement of the arm lever or crank through the same selectable angle;

the arm lever or crank being interconnected to a resistance mechanism that resists movement of the arm and the foot support through the arm lever or crank.

In such an embodiment, the arm lever or crank is preferably interconnected to a second crank or lever that is interconnected to the rear linkage; the arm crank or lever and the second crank or lever being interconnected such that driven movement of one of the arm and the foot support causes simultaneous movement of the other of the arm and the foot support. The second crank or lever is typically interconnected to the resistance mechanism in an arrangement such that driven movement of one or the other of the arm and the foot support causes the resistance mechanism to be driven through the second crank or lever.

In such an embodiment, the arm lever or crank is typically interconnected to a second crank or lever; the second crank or lever being interconnected to a third crank or lever that is connected to the resistance mechanism; the arm being interconnected to the resistance mechanism through the second and third cranks or levers. The rear linkage is typically interconnected to the arm through the second crank in an arrangement such that driven movement of one of the arm or the foot support causes the other of the arm or the foot support to be moved. The rear linkage can be adapted to be selectively adjustable to limit the back and forth travel of the frame linkage to any one of a plurality of separate reproducible segments of the overall arcuate path.

In another aspect of the invention there is provided an exercise device comprising:

a foot support arranged on a frame for supporting a user standing upright on the foot support, the foot support being movable back and forth between a rearward position and a forward position along an arcuate path on a ramp mounted to the frame;

the foot support being supported on a rear linkage that is pivotally interconnected to an intermediate crank or lever;

the intermediate crank or lever being interconnected to a resistance crank or lever that is connected to a resistance mechanism;

the foot support being interconnected to the resistance mechanism through the intermediate and resistance cranks or levers.

In such an embodiment, the apparatus preferably includes an arm having a handle that is interconnected to the intermediate crank or lever such that movement of one of the arm or foot support causes movement of the other of the arm or foot support.

Further in accordance with the invention there is provided, a method of performing an exercise comprising placing an exerciser's foot on an exercise machine having a foot support supported on a frame for back and forth movement, the method comprising:

supporting the foot support on an arcuate ramp and adapting the foot support to be drivably movable in along the arcuate ramp from back to front and front to back along the same path of travel in both directions;

interconnecting the foot support to a resistance mechanism with at least two crank mechanisms, the crank mechanisms being drivably interconnected to and disposed between the resistance mechanism and the foot support;

driving the foot support with the exerciser's foot to drive the resistance mechanism through the at least two cranks.

Preferably such a method includes interconnecting the foot support to a manually graspable arm that is mounted to the frame at a select pivot point for forward and backward movement around the pivot point;

adapting the foot support and the arm to move and to pivot in unison through their interconnection;

driving one or the other or both of the foot support and the arm to drive the resistance mechanism through the at least two cranks.

Such a method further preferably comprises rigidly connecting or interconnecting a lever to the arm or the foot support such that the lever pivots in unison with the arm, and interconnecting the lever to one of the at least two cranks that interconnect to the resistance mechanism.

In another aspect of the invention there is provided, an exercise apparatus comprising:

a frame;

a curved ramp comprised of a non-articulating, non-pivoting curved member that defines a unitary curved path of travel between a selected forward and selected rearward position;

a foot support adapted to travel along the unitary curved path from the selected forward position to the selected rearward position and to travel along the unitary curved path from the selected rearward position to the selected forward position;

a handle interconnected to the foot support and adapted to move in the same direction, forward or rearward, as the foot support via the interconnection to the foot support.

In such an embodiment, the curved path of travel preferably comprises a portion of a circumference of a circle having a selected radius.

Further in accordance with the invention there is provided an apparatus for simulating a back and forth leg movement, the apparatus comprising: a pair of pivotable support mechanisms supported on a frame, a pair of foot supports each pivotally mounted on a corresponding one of the support mechanisms for back and forth translation or travel between front to back and up and down positions along a defined arcuate path of translation/travel, the support mechanisms including a ramp mechanism along which the foot supports are guided along the course of travel. The path of travel of the foot support from front to back is the same as the path of travel from back to front. The foot supports are typically slidably or rollably mounted on the ramp mechanism for sliding or rolling movement therealong.

In such an embodiment, the support mechanisms preferably each include an elongated linkage mechanism pivotally linked to a corresponding foot support mechanism. The linkage mechanisms travel front to back together with the foot supports, each of the linkage mechanisms having a front to back axis that remains in substantially parallel or otherwise the same orientation relative to the other linkage mechanism during front to back travel of the foot supports and linkage mechanisms. As the linkage mechanisms travel or translate from front to back, the axes of the linkage mechanisms each remain substantially parallel to a fixed reference axis such as a horizontal axis during front to back translation or travel of the foot supports.

The foot supports typically have a generally planar foot sole receiving surface and are mounted on the support mechanisms such that the sole receiving surfaces of the foot pedals pivot or rotate less than about three degrees during translation, most preferably less than about 2.5 degrees.

The foot supports are preferably mounted in an arrangement on the support mechanisms such that the sole receiving surfaces remain generally parallel to a fixed reference plane during translation along the path of travel. Typically the foot supports remain generally parallel to horizontal during their front to back, up/down travel.

The foot supports are mounted on the support mechanism and linked to the linkage mechanisms such that as the foot supports travel from front to back, the foot supports and the linkages travel either further away from each other or travel closer to each other depending at which point along the path of travel the foot supports are located at any given moment in time. Thus, even though the foot supports and the linkages are travelling either closer to or further away from each other during the course of translation/travel, the orientation of the axes of the linkages and the foot supports remain the same relative to each other and to a fixed frame of reference, e.g. the axes of the linkages remain substantially parallel to each other. Such linkage mechanisms are directly pivotally linked to the foot supports.

The apparatus preferably includes a pair of left and right handles for being grasped by a user's hands each handle pivotally interconnected to a respective one of the left and right foot support such the left handle pivots forwardly together with forward movement of the left foot support, the left handle pivots backwardly together with backward movement of the left foot support, the right handle pivots forwardly together with forward movement of the right foot support and the right handle pivots backwardly together with backward movement of the right foot support.

The foot supports and the handles/input arms are preferably interconnected to a reciprocating mechanism that directs one of the left or right foot supports to travel in the back or forth direction while simultaneously directing the other of the left or right pedals to travel in an opposite direction.

The reciprocating mechanism typically comprises a rotating mechanism having a pair of pivot points, one pivot point pivotally interconnected to one of the left or right foot supports and/or arms and the other pivot point pivotally interconnected to the other of the left or right foot supports and handles/input arms.

The pivot points are typically disposed at substantially opposing 180 degree positions along a circular path of rotation, the foot supports and the handles or arms being interconnected to a respective pivot point by one or more link mechanisms.

In another aspect of the invention there is provided a method for performing a back and forth leg, foot and upper body exercise by a subject on an exercise apparatus, the method comprising:

defining left and right foot paths of travel with a ramp mechanism having an arcutely shaped path of guidance;

positioning the soles of the feet of a subject on a pair of left and right foot supports adapted to travel in a back and forth motion along the arcuately shaped path of guidance;

wherein the subject positions a right or left foot on a respective one of the right or left foot supports; and wherein the subject exerts sufficient energy to move a respective one of the left or right foot supports forwardly or backwardly along the path of guidance.

In another aspect of the invention there is provided a, method for performing a back and forth leg, foot and upper body exercise by a subject on an exercise apparatus, the method comprising:

positioning the soles of the feet of a subject on a pair of left and right foot supports adapted to be moved in a back and forth motion along defined arcuate paths of travel;

the left and right foot supports being respectively interconnected to left and right manually graspable handles, each handle being adapted to pivot forwardly together with forward movement of its respectively interconnected foot support and to pivot backwardly together with backward movement of its respectively interconnected foot support;

wherein the subject positions a right or left foot on a respective one of the right or left foot supports; and wherein the subject exerts sufficient energy to move a respective one of the left or right foot supports forwardly or backwardly and to simultaneously pivot a respective one of the left or right handles forwardly or backwardly.

BRIEF DESCRIPTION OF THE DRAWINGS

The above and further advantages of the invention may be better understood by referring to the following description in conjunction with the accompanying drawings in which.

DETAILED DESCRIPTION

Figure 1:
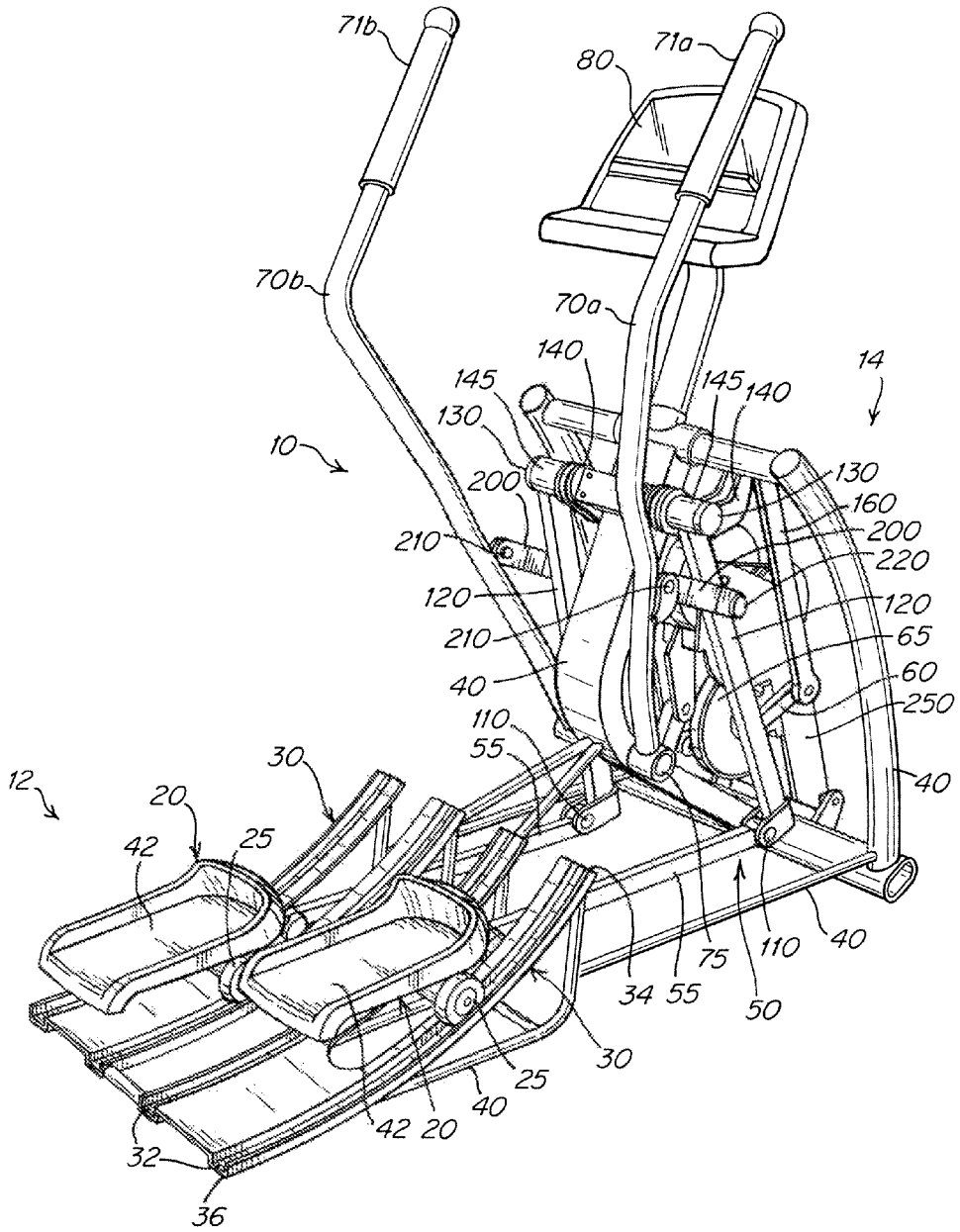
FIG. 1 is a rear perspective view of an apparatus in accordance with the invention.

With reference to FIG. 1, the present invention generally comprises an exercise apparatus 10 that provides a low impact workout yet offers the potential for an intensive cardiovascular workout by eliminating the unnatural motion and awkward foot alignments typical of many stair-climbing and elliptical training devices. The invention provides one or more foot supports 20, typically left and right, movable along an arcuate path defined by corresponding ramps or rails 30 on which the foot supports 20 are typically rollably (e.g. on wheels 25 mounted to the underside of the foot supports 20) or slidably mounted for back and forth, up and down reciprocal movement along ramp 20. The path of the foot supports 20 on or along the ramps/rails 30 is arcuate and preferably is the same identical arcuate path from front to back as from back to front in the course of an exercise cycle by the user of the apparatus 10.

The exercise apparatus 10 includes a stationary frame 40, a frame linkage assembly 50 pivotally/movably engaged with the frame 40, the one or more foot supports 20 being pivotally engaged with the frame linkage assembly 50. The apparatus includes a crank mechanism 60 pivotally engaged with the frame linkage 50. The crank mechanism 60 is typically connected to the axis of a rotor or pulley wheel 65 that exerts a resistance to rotation. As shown in the embodiments illustrated, a variable or variably selectable resistance can be provided through one or more of a series of belts 67, 72 interconnecting the primary pulley wheel 65 to one or more of a series of secondary resistance pulley wheels 69, 73 which, via their size, mass and interconnection to the primary pulley wheel 65 can provide a selected amount of resistance to back and forth movement of the foot supports. Other electromechanical and mechanical mechanisms can be provided to implement resistance to rotation of crank arms 60.

Figure 6:
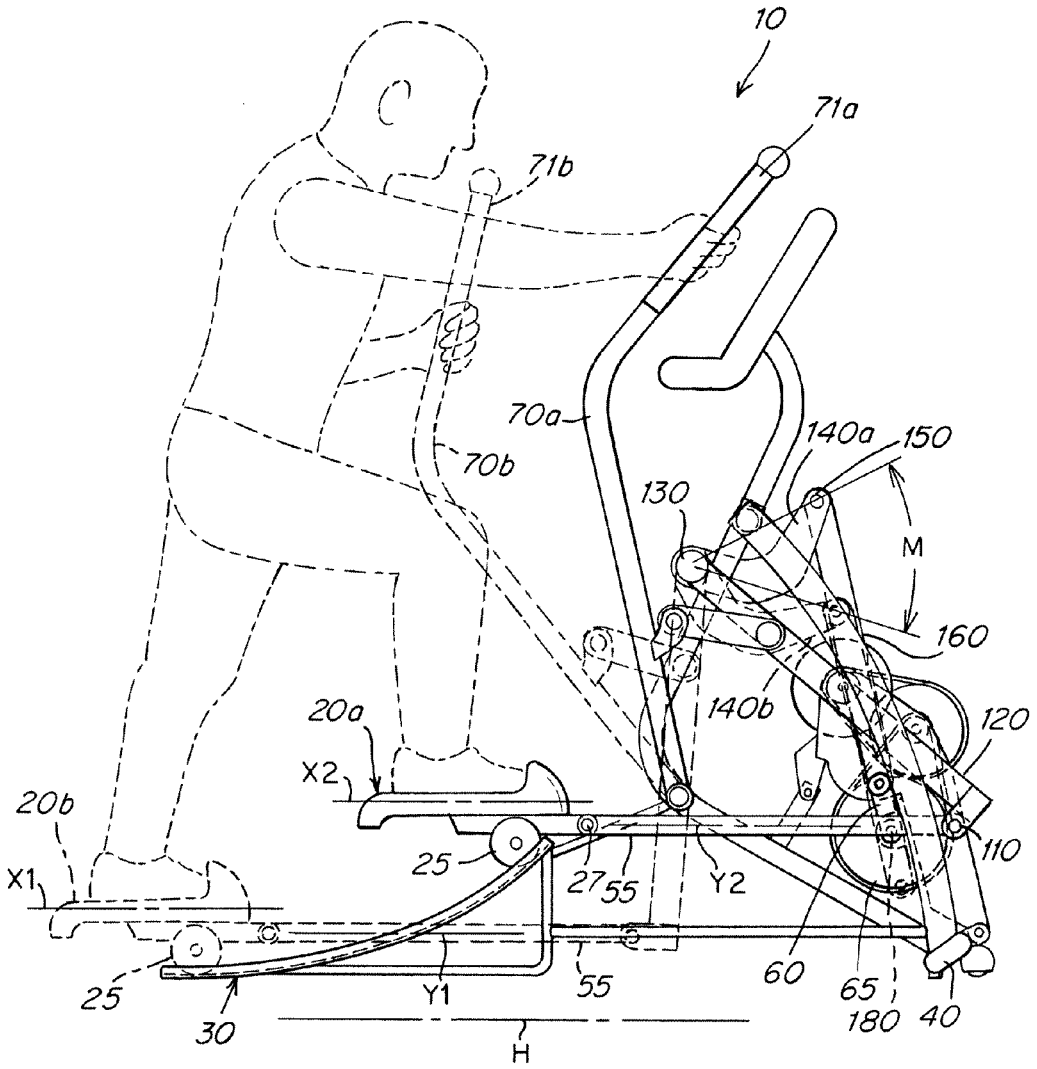
FIG. 6 is a side schematic view of the apparatus of FIG. 1 showing a subject positioned on the apparatus in a select front to back position.

A display/control panel 80 is typically stationarily secured to the stationary frame 40. The foot supports 20 have a generally planar support surface 42 for receiving the sole of a user-subject's foot, FIG. 2. The foot supports 20 have a front to back center axis X and are pivotally interconnected to first direct linkages 55 that has/have a front to back center axis Y. As shown in FIG. 6, on and during travel of the foot supports 20 and linkages 55 from back $X_1, Y_1$ to front $X_2, Y_2$ and from front $X_2, Y_2$ to back $X_1, Y_1$, the axes X and Y remain generally parallel to a fixed reference axis such as axis H. Axis H is typically parallel to or coincident with the ground (i.e. is horizontal) but can also be at an angle to horizontal. Thus the axes $X_1, Y_1$ and $X_2, Y_2$ preferably remain generally parallel to the fixed reference axis H at any point along the course of travel from front to back. FIG. 6 also shows a user at the maximum right-handle-back/right-foot-forward and left-handle-forward/left-foot-back position in the course of an exercise cycle. In such a position, the crank arms 140*a*, 140*b* are disposed at the maximum angle M at which these arms 140 are disposed throughout the course of a full back and forth movement of the foot supports 20 and arms 70.

Figure 5:
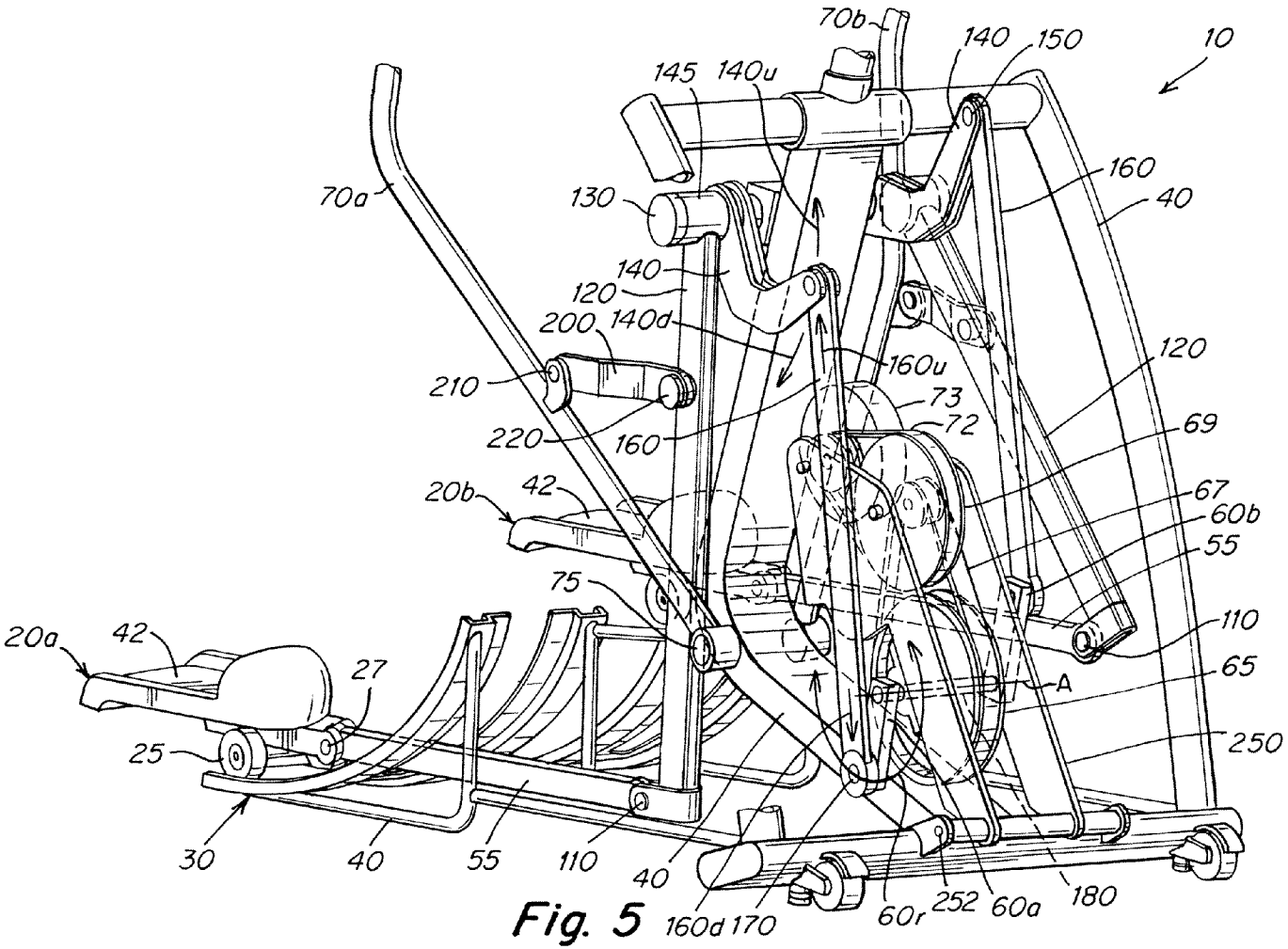
FIG. 5 is a front perspective view of the apparatus of FIG. 1.

The foot supports 20 are typically pivotably connected to the rear linkages 55 at a freely pivoting joint or pivot point 27 such that the axis X of the foot supports 20 can, if necessary rotate around the pivot point 27 during the course of travel of the foot supports 20 from front to back along ramp 30. The foot supports 20 are sized to receive the foot of a subject user and are mounted through the linkages on the ramps/rails 30 in a manner such that the generally planar surfaces 42 of the supports 20 are disposed generally parallel to the fixed frame of reference H, FIG. 6. The fixed frame of reference can be a plane or line coincident with horizontal or the ground or floor on which the apparatus 10 is mounted. The foot supports 20 are pivotally connected to, and supported by, the direct forward linkages 55 at pivot point 27 which is in turn pivotally connected to a forward lever linkage 120 at pivot point 110. The forward lever linkage 120 is in turn pivotally mounted on a stationary member of the stationary frame 40 at pivot point 130. The linkage 120 is rigidly/fixedly interconnected to bell crank arm 140 via collar member 145 which is fixedly connected to both the bell crank arm 140 and linkage 120 such that both the arm and the linkage pivot together with each other around pivot point 130. Crank arm 140 is pivotally interconnected to another linkage member 160 at pivot point 150. Linkage member 160 is in turn pivotally interconnected to crank arm 60 at pivot point 170. With reference to FIG. 5, right and left side crank arms 60*a* and 60*b* are rigidly connected to axle 180 which is in turn rigidly connected to the center of pulley wheel 65 such that as the crank arms 60*a*, 60*b* are drivably rotated around axis A of axle 180, pulley wheel 65 is concomitantly drivably rotated around axis A against the resistance provided by pulley wheel 65 and any associated resistance mechanisms such as described above.

In the embodiments shown in FIGS. 1-6 the left and right side crank arms 60*a*, 60*b* are disposed at 180 degrees out of phase with each other such that maximum lever force and travel distance TD1 or TD2 can be achieved between the forwardmost/upwardmost foot support position of a left or right foot support and the other of the foot supports in a backwardmost/downwardmost position. As shown in the Figures, the ramps 30 are configured and arranged so that the guided path of arcuate travel for a foot support 20 is from vertically downward/horizontally rearward position to a vertically upward/horizontally forward position and vice versa.

The foot supports 20 can include a non-skid surface and be bounded by one or more low lips to help a shoe remain in place on the foot supports during use. Alternately, straps may maintain each foot within the foot support to further retain the user's foot in place during use. However, as used herein, a "foot support" can also encompass any designated support such as a pedal, a pad, a toe clip, or other foot/toe/leg and device interface structure as is known in the art.

Figure 2:
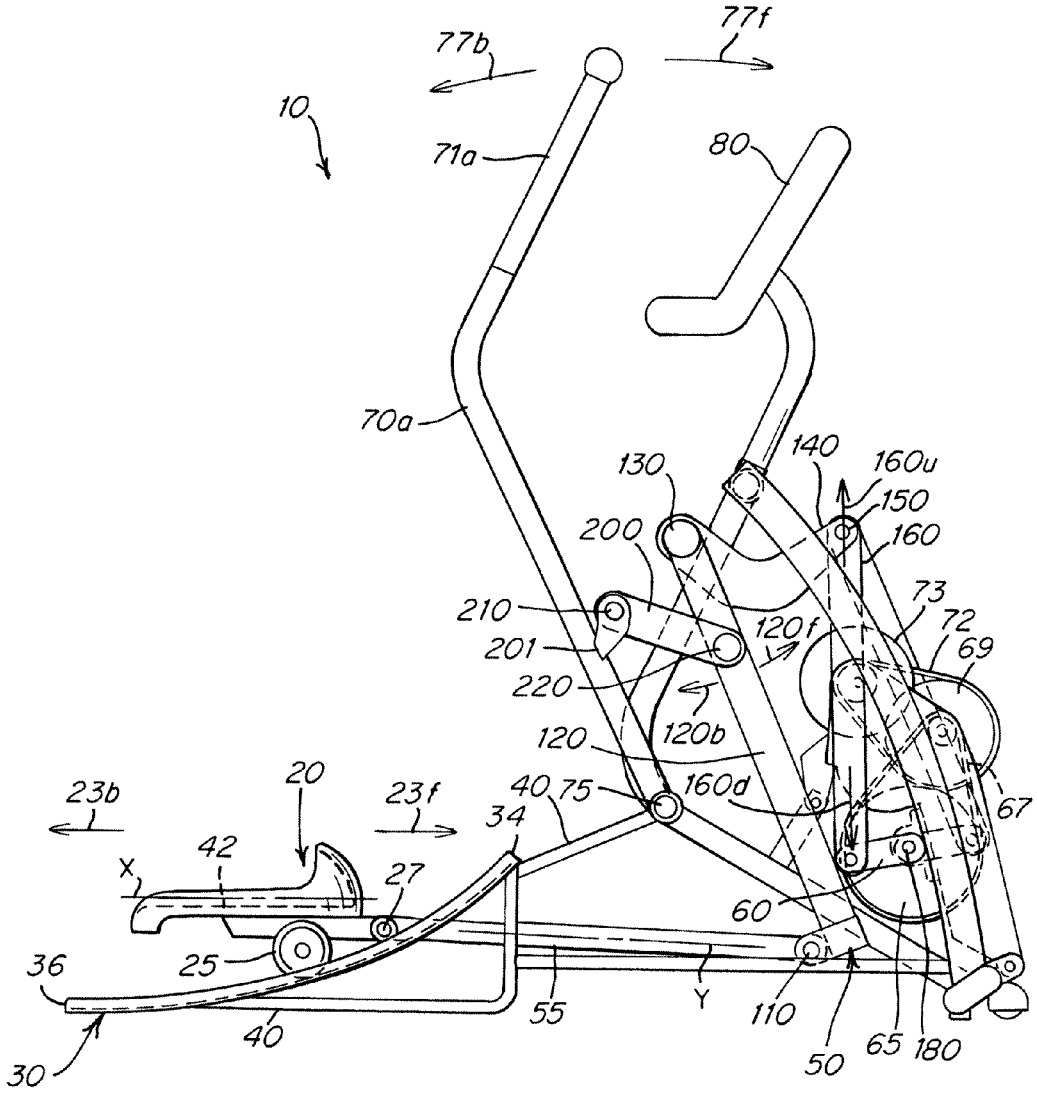
FIG. 2 is a side schematic view of the apparatus of FIG. 1.
Figure 3:
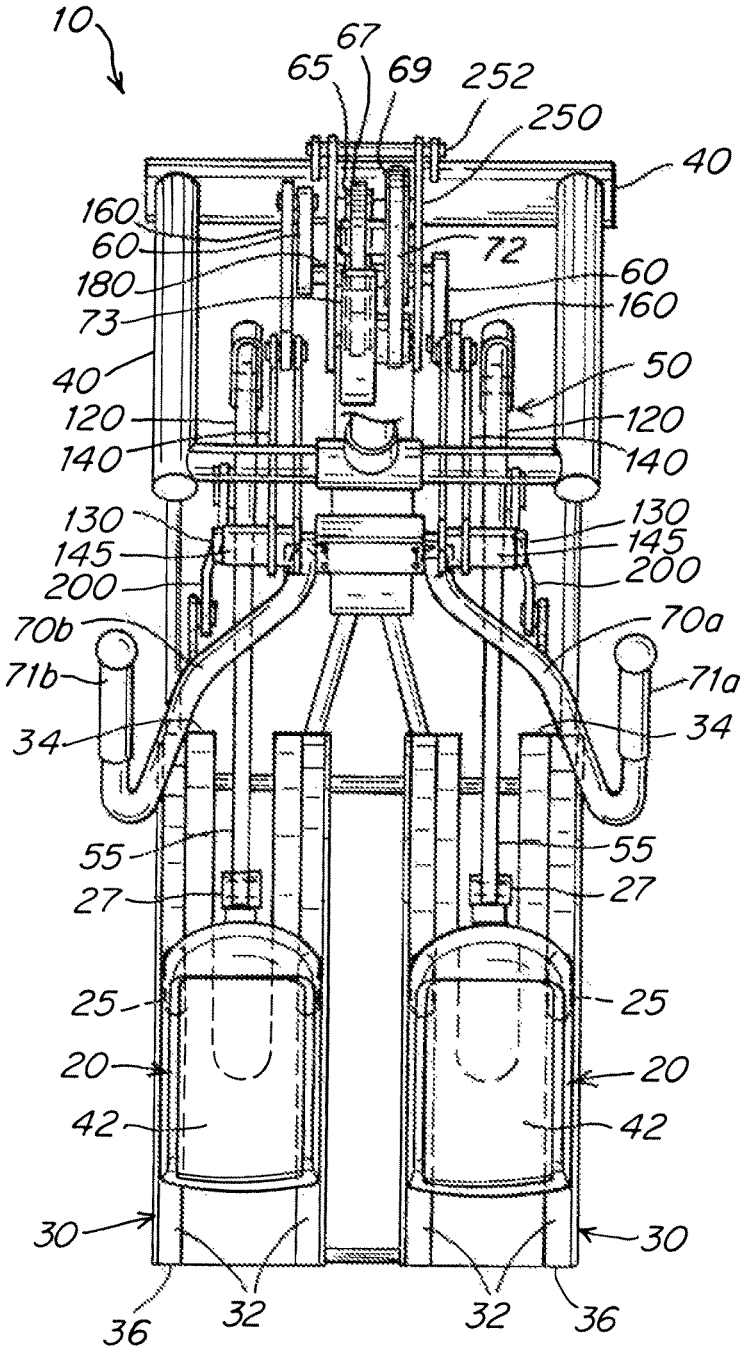
FIG. 3 is a top plan view of the apparatus of FIG. 1.
Figure 4:
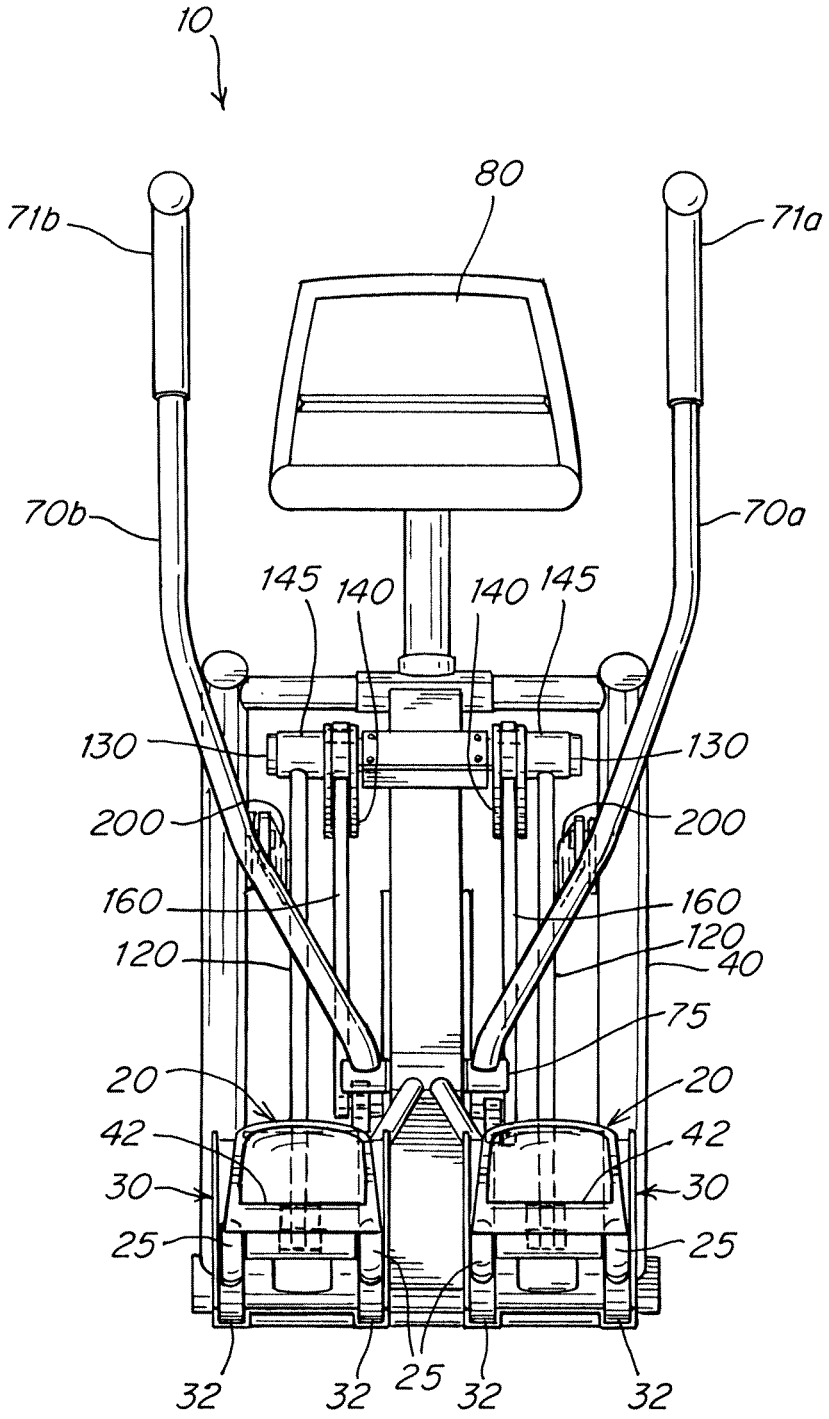
FIG. 4 is a rear view of the apparatus of FIG. 1.

With reference to FIGS. 1-6, in operation, a user approaches the device from the rear region 12 of the apparatus, then moves toward the front region 14 of the apparatus and grasps the hand grips 71 of the input arms 70 which are pivotably mounted to the frame at pivot point 75 for back and forth 77*b*, 77*f* motion, FIG. 2. The user then places a foot on each of the foot supports 20*a*, 20*b* and moves the user's feet in a forward 23*f* and backward 23*b* motion. The user can exert force in performance of the exercise by either forcibly moving the feet and legs on the supports 20*a*, 20*b* or by forcibly moving the handles 71*a*, 71*b* and arms 70*a*, 70*b* fore and aft. As a result of the arrangement of the linkage and other interconnections between the supports 20 and the arms 70, when the user pushes the right arm 71*a* forward and pulls the left arm 71*b* backwardly the corresponding right foot support 20*a* is simultaneously forcibly moved forwardly and the corresponding left foot support 20*b* is simultaneously forcibly moved backwardly. Similarly, when the user pushes the right foot support 20*a* forward and pulls the left foot support 20*b* backwardly the corresponding right arm 70*a* is simultaneously forcibly moved forwardly and the corresponding left arm 70*b* is simultaneously forcibly moved backwardly.

With reference to FIG. 2, the same side, same forward/backward direction motions of the arms 70 and their associated foot pedals 20 is enabled in part by pivotally connecting the arms 70 to the forward crank lever or linkage 120 via an arm linkage 200 that is pivotally connected to the arm 70 on the same side of pivot or fulcrum 75 as handles 71 are connected/disposed on the arms 70. Linkage 200 is connected to lever arm 70*a* at a position between the pivot/fulcrum 75 and the handle 71*a* as shown. The arm linkage 200 is in turn pivotably connected at its forward end by a pivot connection 220 to forward link or lever 120. By locating/positioning the pivot connection 210 of linkage 200 to arm 70 on the same side of the pivot 75 as handle 71, and arranging link/lever 120 to link 55 in the arrangement shown, the forward or backward motion 77*f*, 77*b*, of the handle 71*a* and arm 70*a* is transferred to link 120 as a forward 120*f* or backward 120*b* pivot motion which in turn is transferred to linkage 55 and to foot support 20*a* as a concomitant same left or right side forward 23*f* or backward 23*b* motion.

By way of the same linkages and linkage arrangement, as the left or right foot supports 20*a*, 20*b* move along the arcuate path of the ramps 30 from either front to back or from back to front, the corresponding arms 70*a*, 70*b*, follow/travel in the same forward 77*f* or backward 77*b* direction, FIG. 2. Such following motion is also shown in FIG. 6 for example where the solid lined right side arm 70*a* is in a forward position together with a forward position of the right foot support 20*a* relative to the left side arm 70*b* which is in a backward position together with the left side foot support 20*b* due to the 180 degree out of phase arrangement of the left and right side crank arms 60*a*, 60*b*.

The arms 70 (70*a*, 70*b*) can be proactively used by the subject-user to reduce or transfer the amount of energy or power required by the user's legs and/or feet to cause the foot pedals to travel along the arcuate path of the ramp/rails 30. Thus the subject-user can proactively use the arms as force input to cause the foot supports to travel from back to front by pushing forwardly on the upper end of an arms 70*a* or 70*b*; and vice versa the user can proactively use the arms as force input to cause a foot support to travel from front to back along the ramp by pulling on an arm 70*a* or 70*b*. And, the user can increase the speed of movement of the foot supports by such pushing; or reduce the speed and increase the power or energy required by the legs to effect forward movement by pulling backwardly on the arms. Conversely the user can reduce or transfer the amount of power or energy required to cause the pedals to move from front to back by pulling backwardly on the upper end of the arms. And, the user can increase the speed of rearward movement by such pulling or reduce the speed by pushing; or reduce the speed and increase the power or energy required by the legs to effect rearward movement by pushing.

In the FIGS. 1-8 embodiment, the lever or arm 140 is rigidly connected at its rearward proximal end to the tube or collar 145 as is the upper end of forward linkage 120. Thus when the forward linkage 120 is driven forwardly 120*f* or backwardly 120*b*, the collar 145 is rotated and the lever or bell crank 140 is simultaneously rotated upwardly 140*u* or downwardly 140*d* which in turn causes linkage 160 to be reciprocally driven upwardly 160*u* or downwardly 160*d* which in turn cause crank arms 60*a*, 60*b* to be rotatably driven 60*r* against the resistance of the pulleys 65, 69, 73. In essence there are two cranks, 140 and 60 interconnected between the arms 70 and the resistance mechanism, as well as between the foot supports 20 and the resistance mechanism. The crank arms 60 on the left and right sides are typically attached to opposite ends of the axle 180 at 180 degrees relative to each other. The length of the crank arms 60 is preferably selected relative to the length and arrangement of the other moving components of the system such as link 160, crank arm 140, frame 40 et al. so that the crank arms are rotated 360 degrees when a full back to forth foot support cycle is performed.

The ramps 30 can comprise a flat or other smooth curved surface for rolling or sliding engagement with a mechanism or surface on the underside of the foot supports. The ramps are preferably configured to have a track or groove 32 having a width that is typically slightly larger than the width of the wheels 25 for securely receiving the width of the wheels such that the wheels do not significantly drift side-to-side within the track or groove 32. As can be readily imagined, other rolling or sliding mechanisms such as balls or friction resistant projections could be attached to the underside of the foot supports for insertion within the grooves 32 or sliding engagement on the smooth upper surface of the ramps 30.

Figure 7:
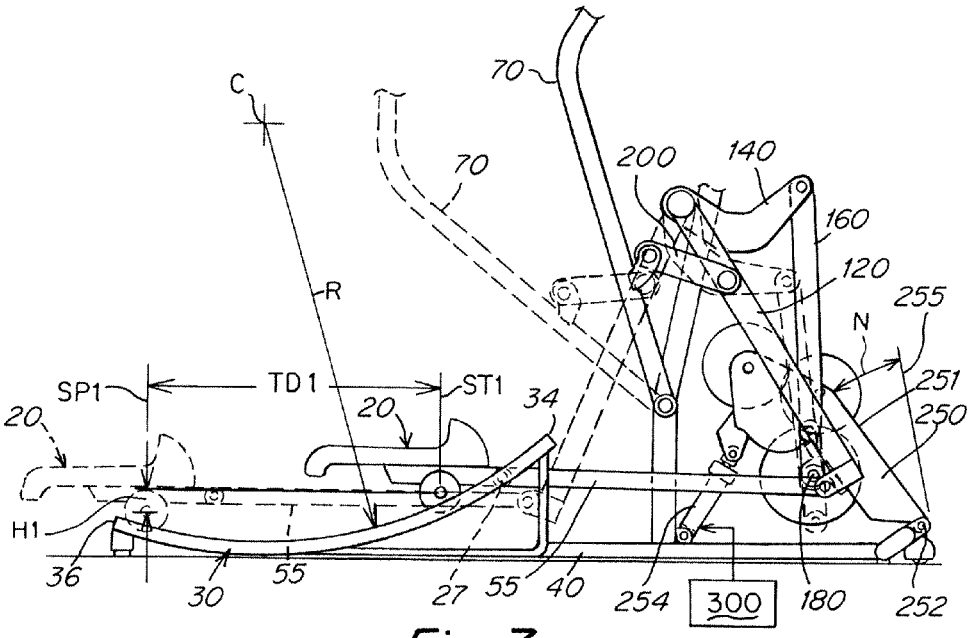
FIG. 7 is a side schematic view of the FIG. 1 apparatus in a first selected arc segment exercise position.
Figure 8:
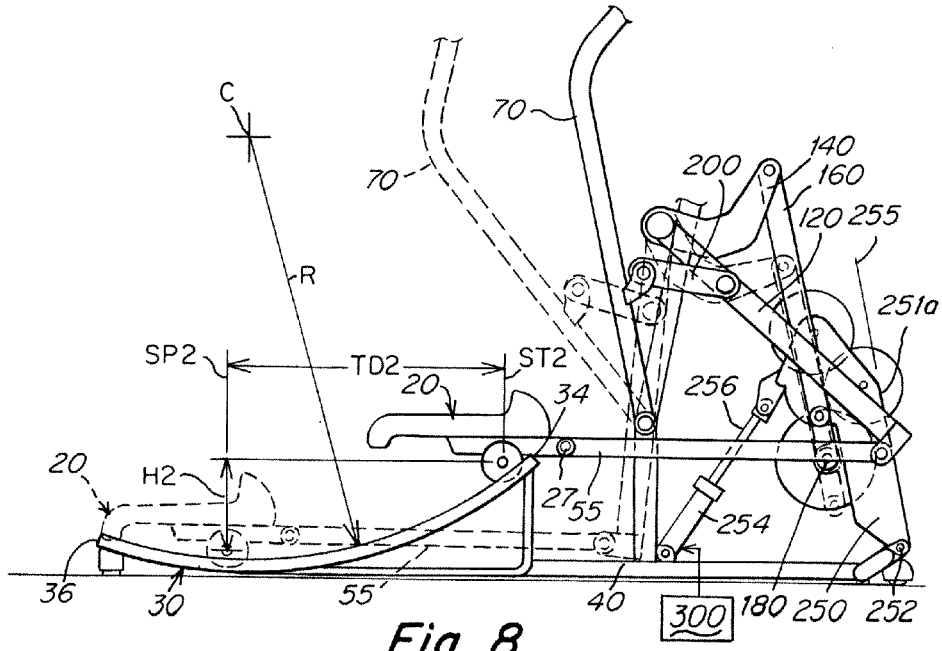
FIG. 8 is a side schematic view of the FIG. 1 apparatus in a second selected arc segment exercise position.

The apparatus can be provided with a mechanism for selecting a sub-arc or segment of the overall arc that extends from the top end 34 to the bottom end 36 of the arcuate ramp 30. As shown in FIGS. 7, 8 a convenient mechanism for providing the ability to select such segments is by mounting the resistance mechanism on a pivoting arm 250 that is pivotably mounted to a pivot 252 connected to the frame 40 and is controllably positionable at a user selectable angle A by actuation of the actuator 254 to either retract or extend the piston 256. The precise angular and spatial position of the axle 180 is determined by the angular position of the arm 250 because the axle 180 is mounted on the arm 250 and moves/translates together with the arm 250. Because the axle 180 is also mechanically interconnected to the foot supports 20 via the various levers, cranks, linkages and pivot mechanisms described above, the precise position in space of the axle 180 will determine the precise starting positions, e.g. SP1, SP2 and the precise stop positions, e.g. ST1, ST2 of the foot supports 20 on the ramps 30.

In the position of the system as shown in the example of FIG. 7, the piston 256 is fully retracted within the cylinder of the actuator 254 thus positioning the rear longitudinal axis 251 of the mounting arm 250 at an angle A relative to generally vertical reference axis 255. In this angled A position, the arc segment through which the foot supports 20 travel have a rearward-most horizontal position of SP1 and a forward-most horizontal position of ST1, the horizontal travel distance of the arc segment being TD1 and the vertical travel distance of the arc segment being H1. In an alternative position of the system as shown in the FIG. 8 example, the piston 256 is extended from the cylinder of the actuator thus positioning the rear longitudinal axis 251*a* coincident with the generally vertical reference axis 255. In this angled position, the arc segment through which the foot supports 20 travel have a rearward-most horizontal position of SP2 and a forward-most horizontal position of ST2, the horizontal travel distance of the arc segment being TD2, and the vertical travel distance of the arc segment being H2. Thus, depending on the degree of extension or retraction of the piston 256 and angled position of the mounting arm 250, the degree of incline of the path of travel of the foot supports 20 on the ramp can be selected and changed between exercise cycles. As known in the art, a user control mechanism 80 can be interconnected to the actuator 254 to select and control the degree of extension/retraction of the piston 256.

As shown by FIGS. 7, 8, the overall or master arcuate path extending from the top 34 to the bottom 36 of the ramp 30 defines the overall longest and steepest arcuate path. Any portion or segment of the overall master arcuate path can be selected by the user at the start of an exercise cycle, such segments having a shorter horizontal travel distance and a shorter vertical height (i.e. less long and less steep) than the overall master arcuate path. In typical embodiments the arcuate path and the segments thereof defined by the ramp 30 comprise a portion of the circumference of a circle having a preselected center CTR and radius R.

In an alternative embodiment of the invention shown in FIGS. 9-15, the apparatus comprises foot supports 320 having foot receiving surfaces, wheels 325 with grooves 325*a* for receiving and engaging the outer surfaces of arcuate tubes 330 that effectively function as a ramp in the same manner as ramp 30. The foot supports 320 can be pivotably connected to the supports linkages 355. The apparatus 300 has a rigid frame 340 on which all of the components and subassemblies of the apparatus are stably mounted. The arms 370 and handles 371 are pivotably mounted for rotation around the axis of pivot 375 formed by a tube or bracket which is mounted to the frame 340. A crank or lever 372 is connected to tube 340 for driven pivoting of tube 340 and lever 372 in unison with arm 370 around the axis of pivot 375. Lever or crank 372 is in turn pivotably connected at pivot 373 to link or lever 376 which in turn is pivotably connected at pivot 377 to crank or lever arm 440 which is in turn pivotably connected at pivot 450 to lever or link 460 which is in turn pivotably connected at pivot 470 to crank arm 360 which is connected rigidly to axle 480 of resistance flywheel or pulley 365 which is connected to resistance pulley 369 via belt 367 which is connected to resistance wheel or pulley 373*a* via belt 372*a*.

Figure 9:
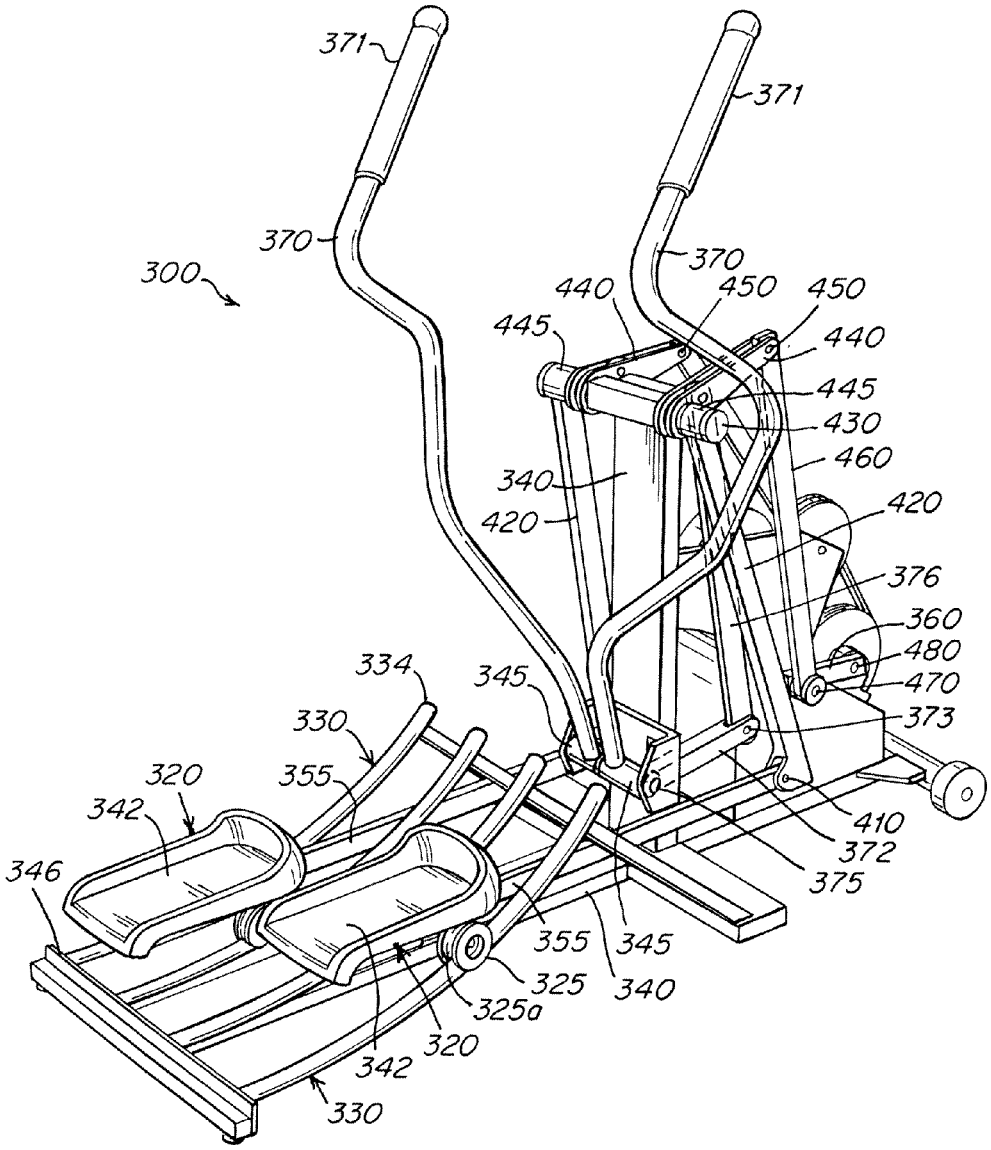
FIG. 9 is a rear perspective view of an alternative embodiment of an apparatus according to the invention in which the handles move in opposite direction to their same side foot pedals.
Figure 10:
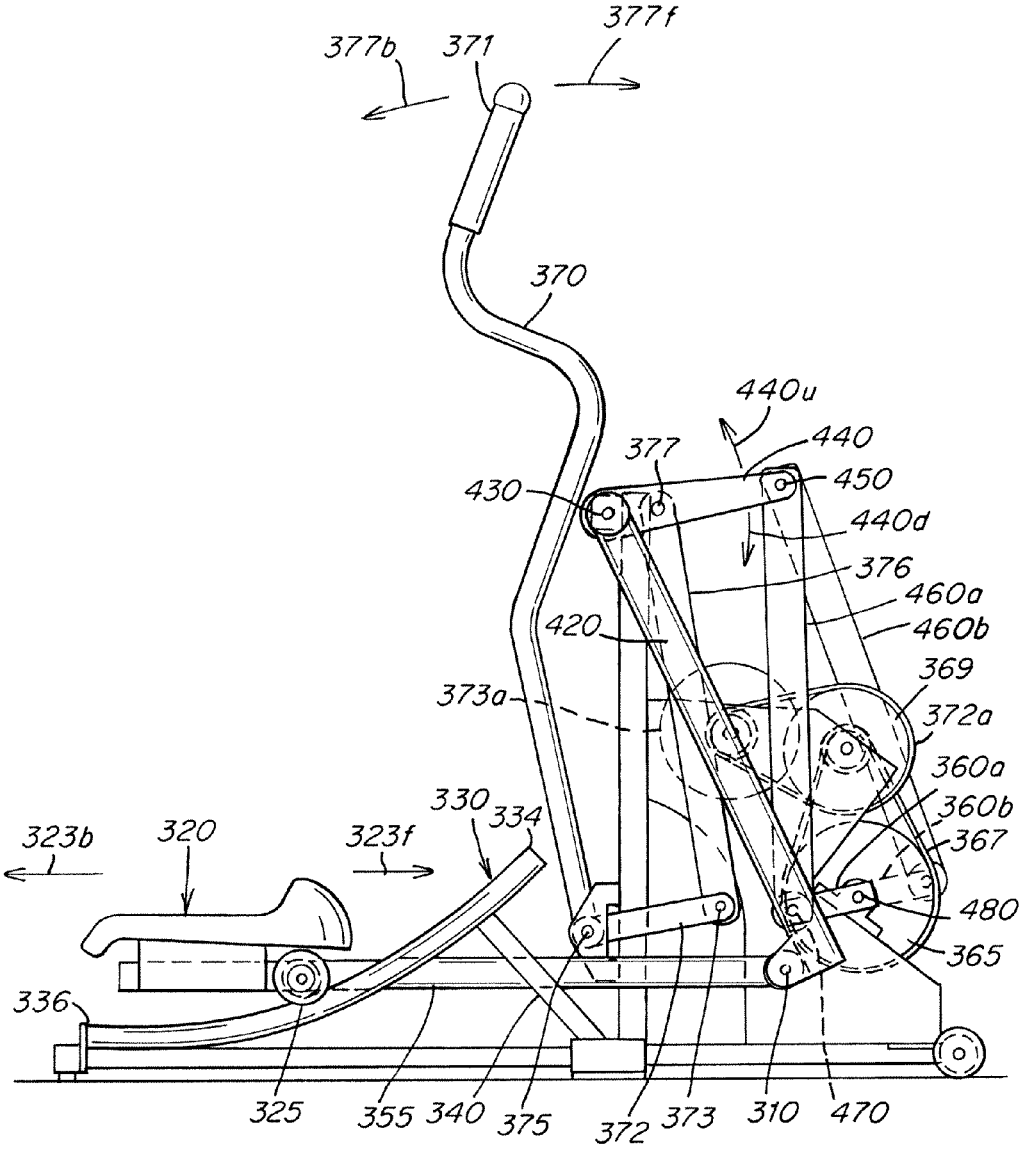
FIG. 10 is a side schematic view of the FIG. 9 apparatus showing foot pedals and arms in a start cycle position.
Figure 11:
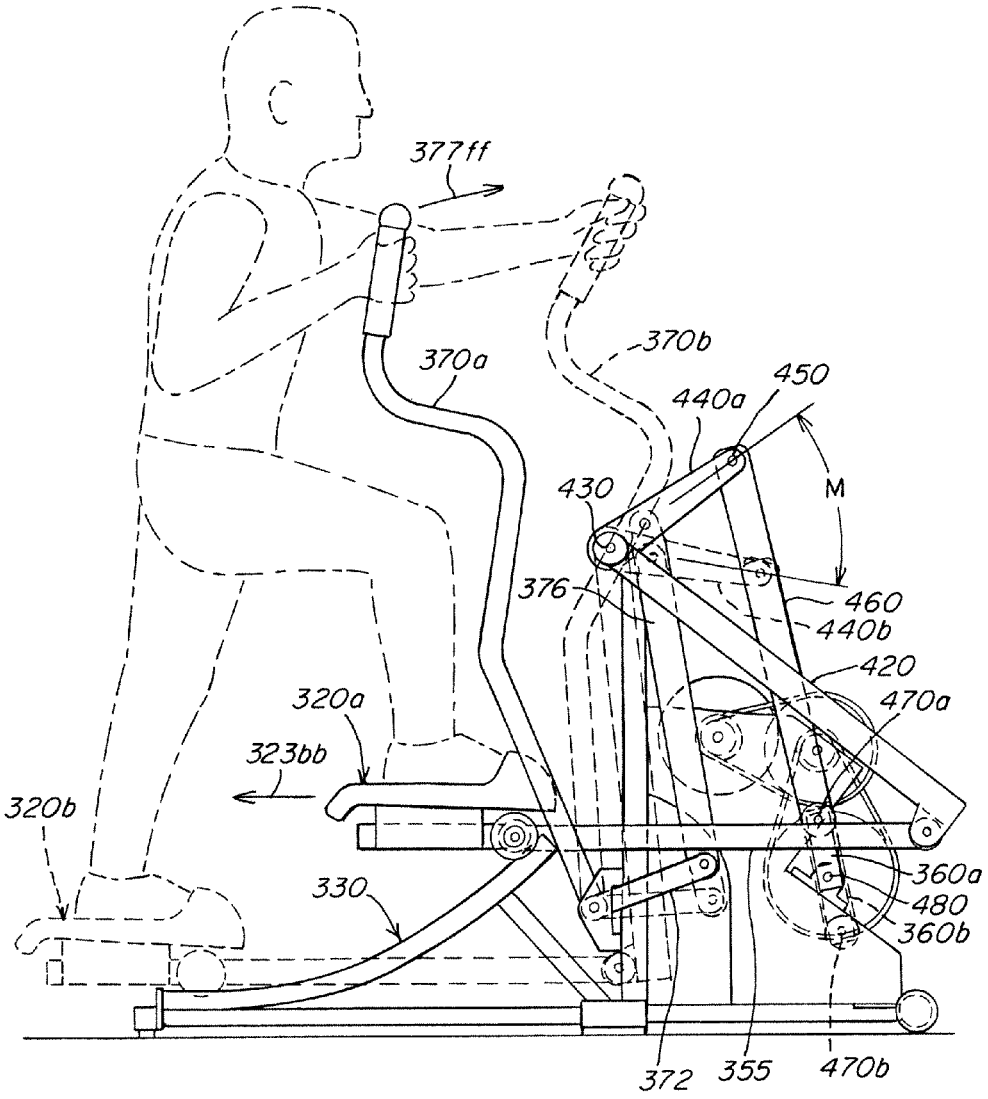
FIG. 11 is a side schematic view of the FIG. 9 apparatus showing a user performing an exercise at the point of maximum elevation of the right pedal and minimum elevation of the left pedal.
Figure 12:
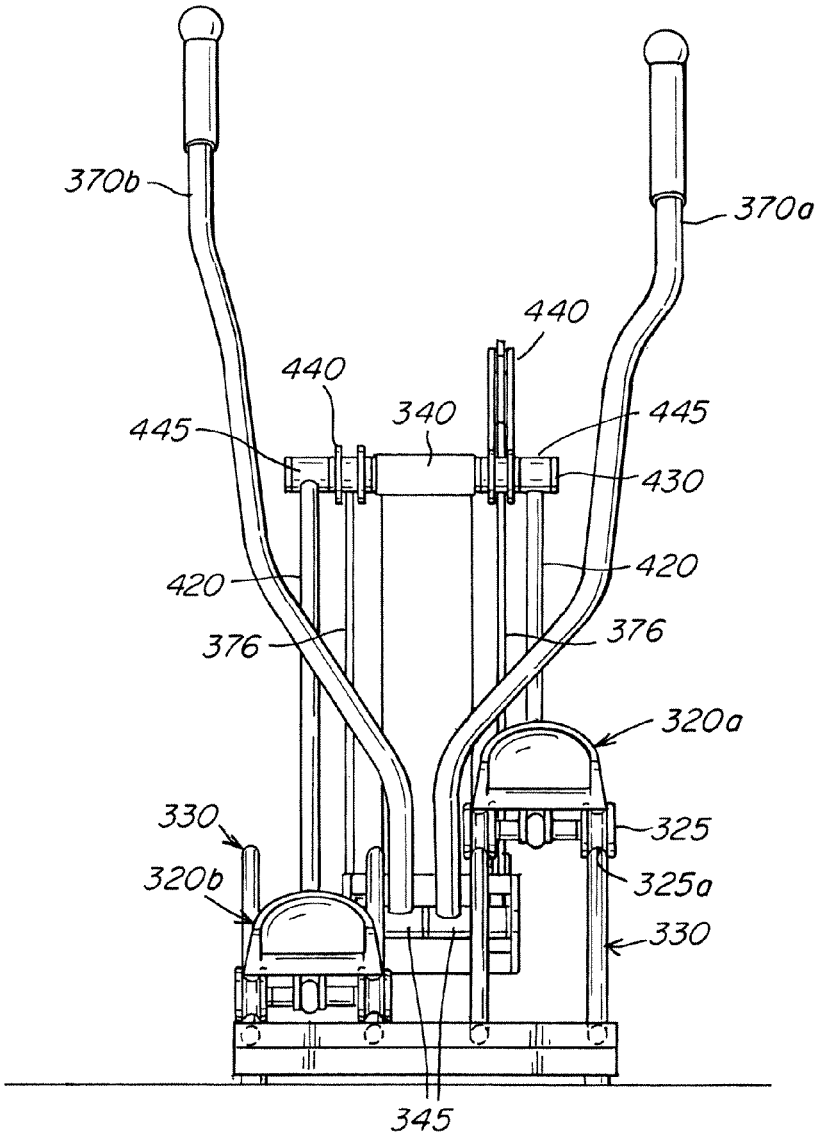
FIG. 12 is a rear view of the FIG. 9 apparatus.
Figure 13:
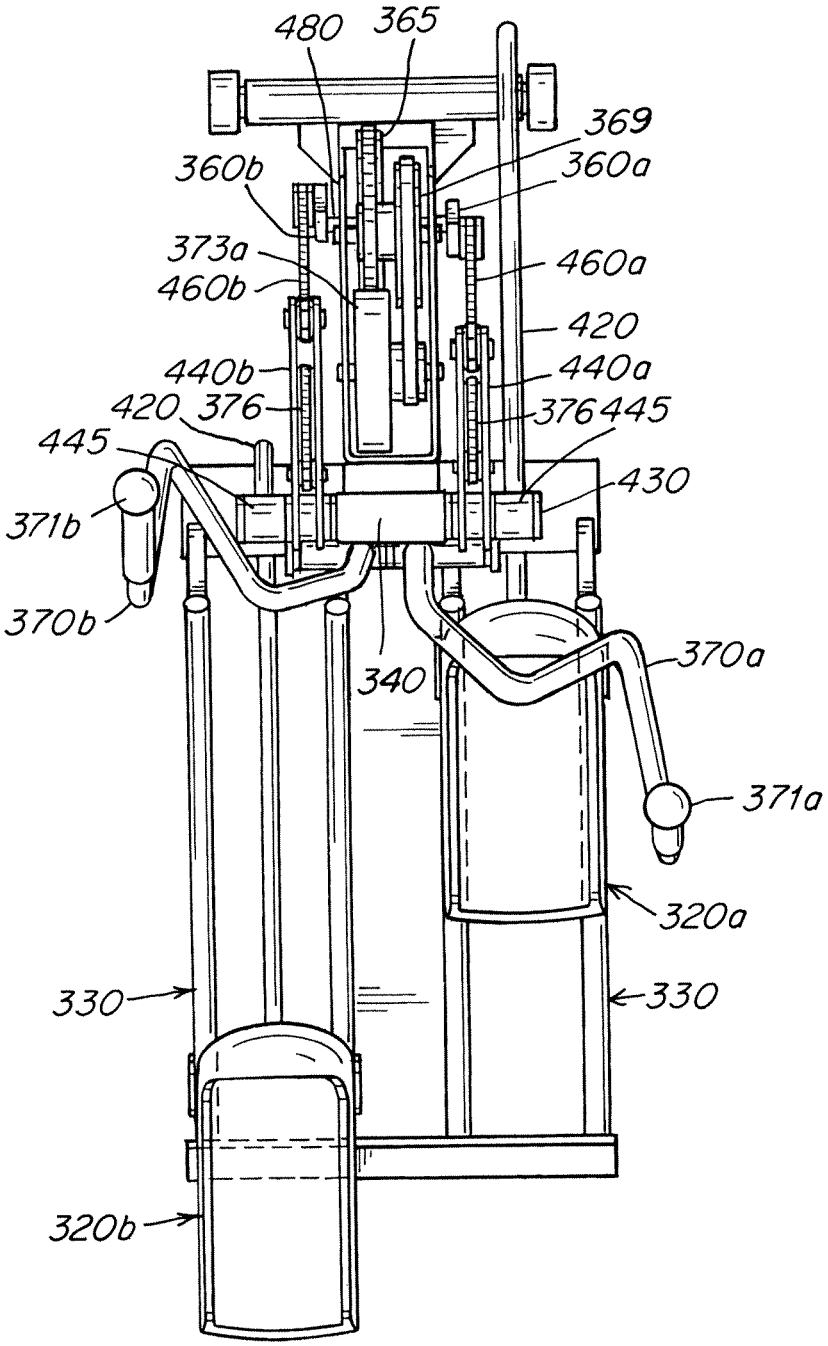
FIG. 13 is a top plan view of the FIG. 9 apparatus.

With reference to FIGS. 9, 10, 11, crank arm 440 and forward linkage 420 are connected at their proximal ends to tube or yoke 445 and pivot together around point 430 when either link 420 or arm 440 move. Thus, in operation by virtue of the arrangement of linkages, pivots and levers, when handle/arm 371/370 is pulled or moved backwardly 377*b*, crank arm 440 is moved upwardly 440*u* by levers 372 and 376. Upward movement 440*u* of crank arm 440 causes link 420 and its connected support linkage 355 and foot support 320 to simultaneously move in the opposite direction of the arm 370, i.e. a foot support 320 moves forwardly 323*f* on backward movement 377*b* of the handle/arm 371/370 on the same side (right or left) of the machine 300. Conversely when handle/arm 371/370 is moved forwardly 377*ff*, FIG. 11, crank arm 440 is moved downwardly 440*d* by levers 372 and 376, FIG. 10. Downward movement 440*d* of crank arm 440 causes link 420 and its connected support linkage 355 and foot support 320 to move in the opposite direction, i.e. foot support 320 moves backwardly 323*bb*, FIG. 11, on forward movement 377*ff* of the handle/arm 371/370 on the same side (right or left) of the machine 300.

FIG. 11 shows a user at the maximum right-handle-back/right-foot-forward and left-handle-forward/left-foot-back position in the course of an exercise cycle. In such a position, the crank arms 440*a*, 440*b* are disposed at the maximum angle M at which these arms 440 are disposed throughout the course of a full back and forth movement of the foot supports 320 and arms 370. The disposition of the generally planar surfaces 342 of the foot supports and the longitudinal axes of the support linkages 355 are shown in FIG. 11 as being generally horizontal in this maximum right-handle-back/right-foot-forward and left-handle-forward/left-foot-back position (same as in the start position) in the same manner as described with reference to FIG. 6 regarding the FIGS. 1-8 embodiment. Preferably the planar surface 342 of the foot supports and the longitudinal axes of the support linkages 355 remain in about the same disposition relative to a selected reference axis, e.g. horizontal, at all positions of the foot support 320 between maximum front and maximum back.

In the FIGS. 9-15 embodiment there are therefore at least two cranks 440 and 360 (and their associated links/levers) interconnected between the arms/handles 370/371 and the resistance mechanism. Similarly there are at least the same two cranks interconnected between the foot supports 320 and the resistance mechanism. As shown, crank arms 440 pivot or rotate in unison with forward linkages 420 both of which are attached to yoke or tube 445. Similarly as shown, lever arm 372 pivots or rotates in unison with arm 370 both of which are attached to yoke or tube 345. Link 376 links lever 372 to crank arm 440.

In the embodiment shown in FIGS. 9-15, the curved arcuate ramp 330 is comprised of curved tubes 330 as opposed to the flat surfaced tracks 30 of the FIGS. 1-8 embodiment. In such an embodiment the wheels 325 have a circumferential groove 325*a* having a width and depth that is complementary in shape/contour to the contour of the outer surface of the tubes 330. In a typical embodiment, the tubes 330 are circular in cross section and the grooves 325*a* are semicircular in cross-section having the same or a slightly larger diameter as the diameter of the cross section of the tubes 330.

Figure 14:
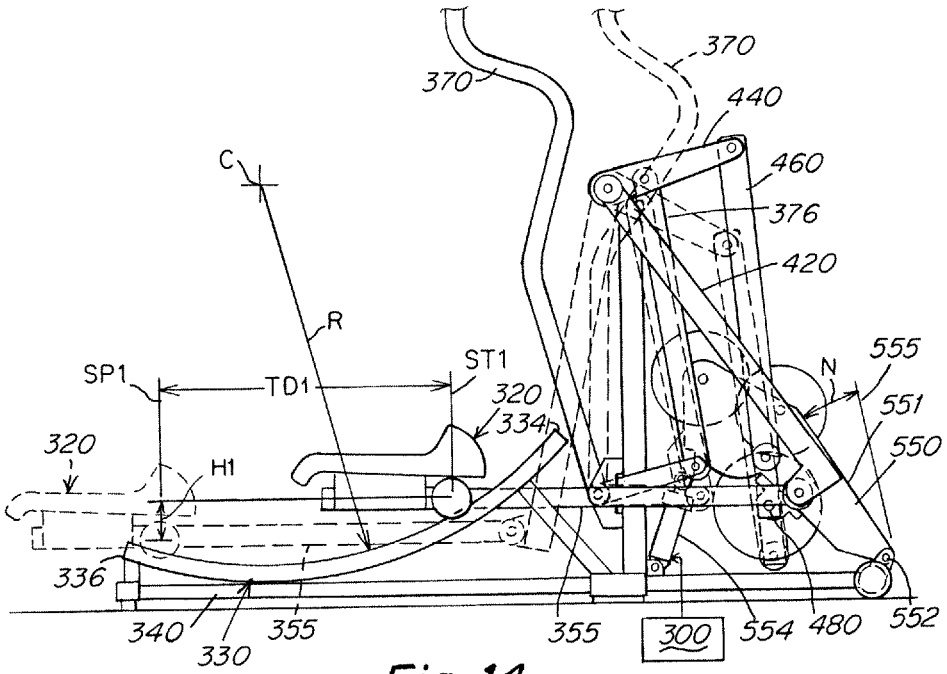
FIG. 14 is a side schematic view of the FIG. 9 apparatus in a first selected arc segment exercise position.
Figure 15:
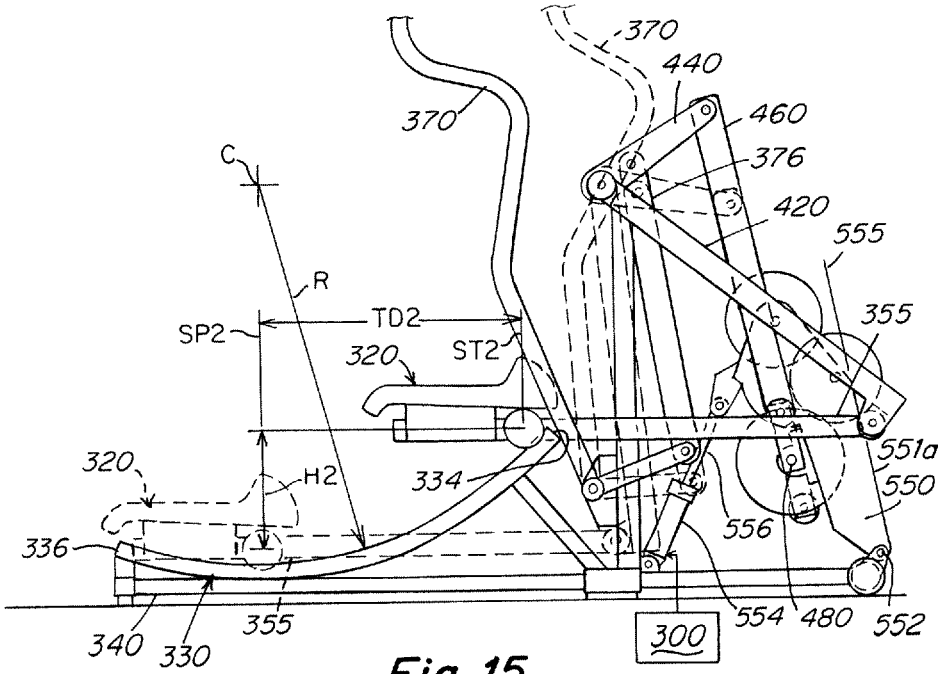
FIG. 15 is a side schematic view of the FIG. 9 apparatus in a second selected arc segment exercise position.

The apparatus 300 of the embodiment of FIGS. 9-15 can be provided with a mechanism for selecting a sub-arc or segment of the overall arc that extends from the top end 334 to the bottom end 336 of the arcuate ramp 330. As shown in FIGS. 14, 15 a convenient mechanism for providing the ability to select such segments is by mounting the resistance mechanism on a pivoting arm 550 that is pivotably mounted to a pivot 552 connected to the frame 40 and is controllably positionable at a user selectable angle A by actuation of the actuator 554 to either retract or extend the piston 556. The precise angular and spatial position of the axle 480 is determined by the angular position of the arm 550 because the axle 480 is mounted on the arm 550 and moves/translates together with the arm 550. Because the axle 480 is also mechanically interconnected to the foot supports 320 via the various levers, cranks, linkages and pivot mechanisms described above, the precise position in space of the axle 480 will determine the precise starting positions, e.g. SP1, SP2 and the precise stop positions, e.g. ST1, ST2 of the foot supports 320 on the ramps 330.

In the position of the system as shown in the example of FIG. 14, the piston 556 is fully retracted within the cylinder of the actuator 554 thus positioning the rear longitudinal axis 551 of the mounting arm 550 at an angle A relative to generally vertical reference axis 555. In this angled A position, the arc segment through which the foot supports 320 travel have a rearward-most horizontal position of SP1 and a forward-most horizontal position of ST1, the horizontal travel distance of the arc segment being TD1 and the vertical travel distance of the arc segment being H1. In an alternative position of the system as shown in the FIG. 15 example, the piston 556 is extended from the cylinder of the actuator thus positioning the rear longitudinal axis 551*a* coincident with the generally vertical reference axis 555. In this angled position, the arc segment through which the foot supports 320 travel have a rearward-most horizontal position of SP2 and a forward-most horizontal position of ST2, the horizontal travel distance of the arc segment being TD2, and the vertical travel distance of the arc segment being H2. Thus, depending on the degree of extension or retraction of the piston 556 and angled position of the mounting arm 550, the degree of incline of the path of travel of the foot supports 320 on the ramp can be selected and changed between exercise cycles. As known in the art, a user control mechanism as described with reference to mechanism 80 can be interconnected to the actuator 554 to select and control the degree of extension/retraction of the piston 556.

As shown by FIGS. 14, 15 the overall or master arcuate path extending from the top 334 to the bottom 336 of the ramp 330 defines the overall longest and steepest arcuate path. Any portion or segment of the overall master arcuate path can be selected by the user at the start of an exercise cycle, such segments having a shorter horizontal travel distance and a shorter vertical height (i.e. less long and less steep) than the overall master arcuate path. In typical embodiments the arcuate path and the segments thereof defined by the ramp 330 comprise a portion of the circumference of a circle having a preselected center C and radius R.

In the embodiments shown in FIGS. 9-13, the left and right side crank arms 360*a*, 360*b* are disposed at 180 degrees out of phase with each other such that maximum lever force and travel distance TD1 or TD2 can be achieved between the forwardmost/upwardmost foot support position of a left or right foot support and the other of the foot supports in a backwardmost/downwardmost position. As shown in the Figures, the ramps 330 are configured and arranged so that the guided path of arcuate travel for a foot support 320 is from a vertically downward/horizontally rearward position to a vertically upward/horizontally forward position and vice versa. As can be readily seen from all of the Figures, the foot pedals always travel in the same arcuate or other configuration of path of travel from front to rear and from rear to front.

Ramps 30 and 330 comprise fixed, unitary non-articulating, non-pivoting structures stationarily mounted to the frame, that define, support and guide the foot supports as unitary structures/members along the same front to back, back to front path of travel of the foot supports.

What is claimed:

1. An exercise device comprising:

a foot support arranged on a frame for supporting a user standing in an upright position on the foot support, the foot support being supported on a rear linkage that is supported on a curved surface of a ramp having a selected curved path of travel, the rear linkage being drivable by the user back and forth along the curved surface of the ramp between a rearwardmost position and a forwardmost position;

the foot support travelling in a path together with the rear linkage along the selected curved path of travel of the ramp from the rearwardmost to the forwardmost position and back along the same path to the rearwardmost position from the forwardmost position, movement of the foot support from the rearwardmost position to the forwardmost position and back to the rearwardmost position along the selected curved path of travel of the curved surface of the ramp defining a complete cycle of exercise movement of the foot support, wherein the rear linkage is pivotally interconnected to an arm mounted to the frame at a selected pivot point for pivoting in a back and forth direction around the selected pivot point, the arm being readily manually graspable by the user on one side of the pivot point for exerting force in a forward or backward direction to forcibly cause the arm to pivot, the interconnection between the arm and the rear linkage being arranged such that the user's exertion of force on the arm in a forward or backward direction drives the rear linkage to travel along the ramp wherein the arm has a handle disposed on the one side of the select pivot point for manual pivoting of the arm around the select pivot point by the user grasping and exerting forward or backward force on the handle; and, the arm is linked to the rear linkage through an arm linkage pivotably connected to the arm on the one side of the select pivot point.

2. The exercise device of claim 1 wherein the arm linkage is connected to a forward linkage that is connected to the rear linkage.

3. An exercise device comprising:

a foot support arranged on a frame for supporting a user standing in an upright position on the foot support, the foot support being supported on a rear linkage that is supported on a curved surface of a ramp having a selected curved path of travel, the rear linkage being drivable by the user back and forth along the curved surface of the ramp between a rearwardmost position and a forwardmost position;

the foot support travelling in a path together with the rear linkage along the selected curved path of travel of the ramp from the rearwardmost to the forwardmost position and back along the same path to the rearwardmost position from the forwardmost position, movement of the foot support from the rearwardmost position to the forwardmost position and back to the rearwardmost position along the selected curved path of travel of the curved surface of the ramp defining a complete cycle of exercise movement of the foot support, wherein the rear linkage is pivotally interconnected to an arm mounted to the frame at a selected pivot point for pivoting in a back and forth direction around the selected pivot point, the arm being readily manually graspable by the user on one side of the pivot point for exerting force in a forward or backward direction to forcibly cause the arm to pivot, the interconnection between the arm and the rear linkage being arranged such that the user's exertion of force on the arm in a forward or backward direction drives the rear linkage to travel along the ramp, wherein the arm is linked to a resistance mechanism through a first crank; and the first crank is pivotably interconnected to the resistance mechanism through a second crank.

4. An exercise device comprising:

a foot support arranged on a frame for supporting a user standing in an upright position on the foot support, the foot support being supported on a rear linkage that is supported on a curved surface of a ramp having a selected curved path of travel, the rear linkage being drivable by the user back and forth along the curved surface of the ramp between a rearwardmost position and a forwardmost position;

the foot support travelling in a path together with the rear linkage along the selected curved path of travel of the ramp from the rearwardmost to the forwardmost position and back along the same path to the rearwardmost position from the forwardmost position, movement of the foot support from the rearwardmost position to the forwardmost position and back to the rearwardmost position along the selected curved path of travel of the curved surface of the ramp defining a complete cycle of exercise movement of the foot support, wherein the rear linkage is linked to a resistance mechanism through a first crank; and the first crank is pivotably interconnected to the resistance mechanism through a second crank.

5. An exercise device comprising:

a foot support arranged on a frame for supporting a user standing in an upright position on the foot support, the foot support being supported on a rear linkage that is supported on a curved surface of a ramp having a selected curved path of travel, the rear linkage being drivable by the user back and forth along the curved surface of the ramp between a rearwardmost position and a forwardmost position;

the foot support travelling in a path together with the rear linkage along the selected curved path of travel of the ramp from the rearwardmost to the forwardmost position and back along the same path to the rearwardmost position from the forwardmost position, movement of the foot support from the rearwardmost position to the forwardmost position and back to the rearwardmost position along the selected curved path of travel of the curved surface of the ramp defining a complete cycle of exercise movement of the foot support, wherein the rear linkage is interconnected to a forward linkage; and the forward linkage is interconnected to a resistance mechanism through a crank.

6. An exercise device comprising:

a foot support arranged on a frame for supporting a user standing in an upright position on the foot support, the foot support being supported on a rear linkage that is supported on a curved surface of a ramp having a selected curved path of travel, the rear linkage being drivable by the user back and forth along the curved surface of the ramp between a rearwardmost position and a forwardmost position;

the foot support travelling in a path together with the rear linkage along the selected curved path of travel of the ramp from the rearwardmost to the forwardmost position and back along the same path to the rearwardmost position from the forwardmost position, movement of the foot support from the rearwardmost position to the forwardmost position and back to the rearwardmost position along the selected curved path of travel of the curved surface of the ramp defining a complete cycle of exercise movement of the foot support, wherein the rear linkage is pivotally interconnected to an arm mounted to the frame at a selected pivot point for pivoting in a back and forth direction around the selected pivot point, the arm being readily manually graspable by the user on one side of the pivot point for exerting force in a forward or backward direction to forcibly cause the arm to pivot, the interconnection between the arm and the rear linkage being arranged such that the user's exertion of force on the arm in a forward or backward direction drives the rear linkage to travel along the ramp, wherein the rear linkage is interconnected to a forward linkage; and the forward linkage is connected to the arm linkage and a crank.

7. The exercise device of claim 6 wherein the crank is interconnected to a second crank.

8. An exercise device comprising:

a foot support arranged on a frame for supporting a user standing upright on the foot support, the foot support being movable back and forth from a rearwardmost position to a forwardmost position along a path of selected curvature along a support surface on a ramp mounted to the frame, the foot support being supported on a rear linkage that is supported on the support surface of the ramp to cause movement of the foot support along the path of selected curvature from the rearwardmost position to the forwardmost position back along the same path to the rearwardmost position defining a complete cycle; and, an incline selector interconnected to the foot support, the incline selector being adjustable to effectively select one or more segments of the path along the ramp, each segment having a separate degree of incline, a different rearwardmost and forwardmost position and thus a different degree of incline such that a complete cycle of the foot supports on the support surface can be effectively changed, wherein the rear linkage is pivotally interconnected to a manually graspable arm that is pivotably mounted to the frame at a select pivot point;

the arm having a handle disposed on one side of the select pivot point for manual pivoting of the arm around the select pivot point by the user grasping and exerting forward or backward force on the handle; and the arm being linked to the rear linkage through an arm linkage pivotably connected to the arm; on the one side of the select pivot point.

9. The exercise device of claim 8 wherein the arm is interconnected to a resistance mechanism through a crank.

10. The exercise device of claim 8 wherein:

the arm is linked to a resistance mechanism through a first crank; and the first crank is pivotably interconnected to the resistance mechanism through a second crank.

11. The exercise device of claim 8 wherein the arm linkage is connected to a forward linkage that is connected to the rear linkage.

12. The exercise device of claim 8 wherein:

the rear linkage is connected to a forward linkage; and the forward linkage being connected to the arm linkage and a crank.

13. The exercise device of claim 12 wherein the crank is interconnected to a second crank.

14. An exercise device comprising:

a foot support arranged on a frame for supporting a user standing upright on the foot support, the foot support being movable back and forth from a rearwardmost position to a forwardmost position along a path of selected curvature along a support surface on a ramp mounted to the frame, the foot support being supported on a rear linkage that is supported on the support surface of the ramp to cause movement of the foot support along the path of selected curvature from the rearwardmost position to the forwardmost position back along the same path to the rearwardmost position defining a complete cycle; and, an incline selector interconnected to the foot support, the incline selector being adjustable to effectively select one or more segments of the path along the ramp, each segment having a separate degree of incline, a different rearwardmost and forwardmost position and thus a different degree of incline such that a complete cycle of the foot supports on the support surface can be effectively changed wherein the rear linkage is linked to a resistance mechanism through a first crank; and the first crank is pivotably interconnected to the resistance mechanism through a second crank.

15. An exercise device comprising:

a foot support arranged on a frame for supporting a user standing upright on the foot support, the foot support being movable back and forth from a rearwardmost position to a forwardmost position along a path of selected curvature along a support surface on a ramp mounted to the frame, the foot support being supported on a rear linkage that is supported on the support surface of the ramp to cause movement of the foot support along the path of selected curvature from the rearwardmost position to the forwardmost position back along the same path to the rearwardmost position defining a complete cycle; and, an incline selector interconnected to the foot support, the incline selector being adjustable to effectively select one or more segments of the path along the ramp, each segment having a separate degree of incline, a different rearwardmost and forwardmost position and thus a different degree of incline such that a complete cycle of the foot supports on the support surface can be effectively changed wherein the rear linkage is interconnected to a forward linkage; and the forward linkage is interconnected to a resistance mechanism through a crank.

16. An exercise device comprising:

a foot support arranged on a frame for supporting a user standing upright on the foot support, the foot support being movable back and forth from a rearward position to a forward position along a path of travel of selected curvature of a support surface of a ramp mounted to the frame;

the foot support being supported on a rear linkage that is supported on the support surface of the ramp and pivotally interconnected to a manually graspable arm that is pivotably mounted to the frame at a select pivot point for pivoting back and forth through a selectable angle, the arm and the foot support being drivable by the user and interconnected such that driven back and forth movement of one of the arm or the foot support causes driven back and forth movement of the other;

the foot support travelling together with the rear linkage on the ramp along the path of travel of selected curvature of the support surface of the ramp from the rearwardmost to the forwardmost position and back along the same path to the rearwardmost position from the forwardmost position, movement of the foot support from the rearwardmost position to the forwardmost position and back to the rearwardmost position along the path of travel of selected curvature of the ramp defining a complete cycle of exercise movement of the foot support wherein the arm is interconnected to a first crank or lever;

the first crank or lever being interconnected to second crank or lever that is connected to a resistance mechanism; and the arm being interconnected to the resistance mechanism through the second and third cranks or levers.

17. The exercise device of claim 16 wherein:

the rear linkage is interconnected to the arm through the first crank in an arrangement such that driven movement of one of the arm or the foot support causes the other of the arm or the foot support to be moved.

18. An exercise device comprising:

a foot support arranged on a frame for supporting a user standing upright on the foot support, the foot support being movable back and forth from a rearward position to a forward position along a path of travel of selected curvature of a support surface of a ramp mounted to the frame;

the foot support being supported on a rear linkage that is supported on the support surface of the ramp and pivotally interconnected to a manually graspable arm that is pivotably mounted to the frame at a select pivot point for pivoting back and forth through a selectable angle, the arm and the foot support being drivable by the user and interconnected such that driven back and forth movement of one of the arm or the foot support causes driven back and forth movement of the other;

the foot support travelling together with the rear linkage on the ramp along the path of travel of selected curvature of the support surface of the ramp from the rearwardmost to the forwardmost position and back along the same path to the rearwardmost position from the forwardmost position, movement of the foot support from the rearwardmost position to the forwardmost position and back to the rearwardmost position along the path of travel of selected curvature of the ramp defining a complete cycle of exercise movement of the foot support the exercise device further comprising an arm linkage interconnecting the arm and the rear linkage such that the arm moves backward and the rear linkage moves forward when the arm linkage is pivotally connected on one side of the selected pivot point and the arm and the rear linkage move forward together and backward together when the arm linkage is connected to the arm at or on an opposite side of the selected pivot point.

* * * * *